US005762570A

United States Patent [19]

Shaw

[11] Patent Number: 5,762,570

[45] Date of Patent: Jun. 9, 1998

[54] GAME RACKET HAVING A HEAD FRAME CAPABLE OF ABSORBING SHOCK

[76] Inventor: Ching-Song Shaw, 4F, No. 501, Sec. 2, Wu Chuan W. Rd., Taichung, Taiwan

[21] Appl. No.: 852,603

[22] Filed: May 7, 1997

[51] Int. Cl.[6] ..... A63B 49/00

[52] U.S. Cl. ..... 473/522; 473/539; 473/548

[58] Field of Search ..... 473/520, 521, 473/522, 539, 548

[56] References Cited

U.S. PATENT DOCUMENTS

| | | | |
|---|---|---|---|
| 4,204,681 | 5/1980 | Hall, Jr. et al. | 473/539 |
| 4,889,337 | 12/1989 | Todd | 473/522 |
| 4,909,511 | 3/1990 | De Ville et al. | 473/522 |
| 4,949,968 | 8/1990 | Korte-Jungermann | 473/539 |
| 4,993,711 | 2/1991 | De Ville et al. | 473/522 |
| 5,098,099 | 3/1992 | Liu | 473/548 |
| 5,290,031 | 3/1994 | Natsume | 473/539 X |
| 5,306,004 | 4/1994 | Soong | 473/522 |
| 5,368,297 | 11/1994 | Liu | 473/539 |

*Primary Examiner*—William E. Stoll
*Attorney, Agent, or Firm*—Browdy and Neimark

[57] ABSTRACT

A game racket has a head frame consisting of a string protective strip and a shock-absorbing strip. The string protective strip is provided with a plurality of string protective jackets tubular in shape and having an axial through hole. The string protective strip is secured to a recessed portion of the outer wall of the head frame such that the string protective jackets are received in the string holes of the head frame. The shock-absorbing strip is provided with a plurality of shock-absorbing bodies each having a fitting portion, a shock-absorbing portion and a through hole for accommodating the string. The shock-absorbing strip is secured to a recess of the string protective strip such that shock-absorbing bodies are fitted into the axial through holes of the string protective jackets, and that the shock-absorbing portions of the shock-absorbing bodies are exposed from the free ends of the string protective jackets.

6 Claims, 4 Drawing Sheets

GAME RACKET HAVING A HEAD FRAME CAPABLE OF ABSORBING SHOCK

FIELD OF THE INVENTION

The present invention relates generally to a game racket, and more particularly to a game racket with a head frame capable of absorbing shock.

BACKGROUND OF THE INVENTION

As shown in FIG. 1, a conventional game racket consists of a head frame 1, a neck 2 extending from one end of the head frame 1, and a handle 3 extending from one end of the neck 2. The handle 3 is generally provided with a means for mitigating the shock wave transmitted from the head frame 1 to the handle 3. In order to provide the game racket with a more effective means for absorbing the shock wave of the strings, the head frame 1 is provided with a shock-absorbing block 4 for lessening the transmission of shock wave to the handle 3 from the head frame 1.

Such a shock-absorbing block 4 as described above is limited in design in that it is unable to absorb effectively the shock wave of the main strings and the cross strings, which are up to at least more than 70 strings in total. An increase in the number of the shock-absorbing block 4 is not a workable solution in view of the fact that the shock-absorbing blocks 4 can undermine the ball-hitting effect of the game racket, and that the shock-absorbing blocks 4 are vulnerable to becoming detached from the strings of the head frame 1.

SUMMARY OF THE INVENTION

The primary objective of the present invention is to provide each of the main strings and the cross strings of a game racket with a string protective jacket capable of absorbing shock and free from the drawbacks of the prior art game racket described above.

In keeping with the principle of the present invention, the foregoing objective of the present invention is attained by a game racket composed of an improved head frame having a plurality of main strings and cross strings, which are provided respectively with a string protective jacket fastened to one of the string holes of the head frame for absorbing the shock wave generated by the impact of a ball hitting the strings. The string protective jackets are provided respectively with a fitting tube which is lodged in a string hole of the head frame and is provided with an axial hole in which the string and a shock-absorbing block of the shock-absorbing string are received.

The foregoing objective, features and functions of the present invention will be more readily understood upon a thoughtful deliberation of the following detailed description of the present invention with reference to the accompanying drawings.

DETAILED DESCRIPTION OF THE INVENTION

Figure 1:
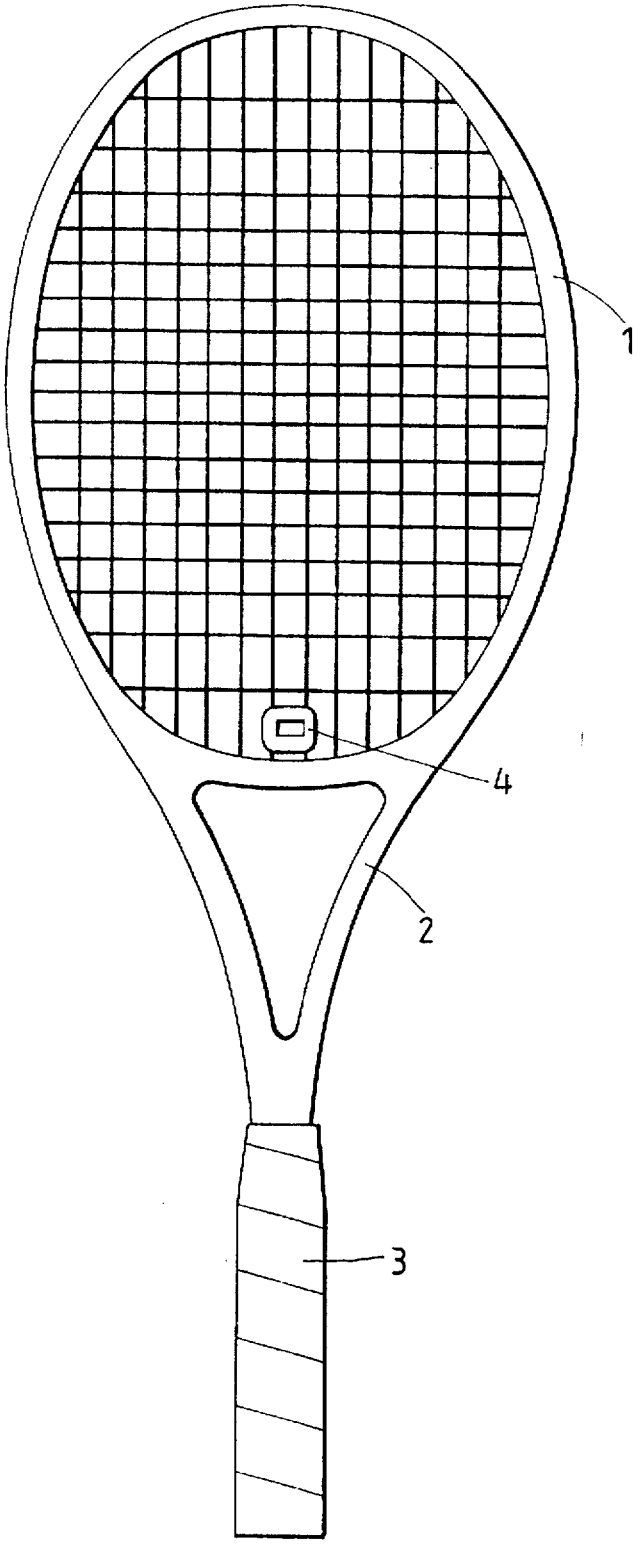
FIG. 1 (PRIOR ART)
FIG. 1 shows a schematic view of a prior art game racket having a shock-absorbing block which is attached to the head frame thereof.
Figure 2:
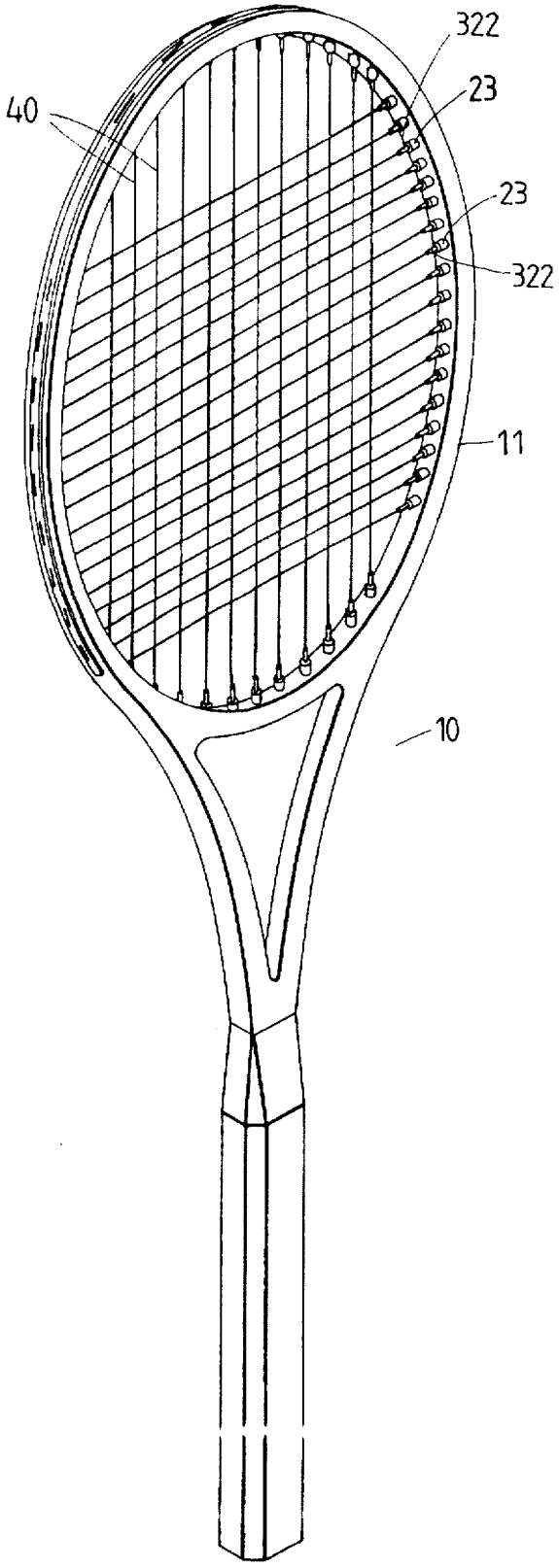
FIG. 2 shows a perspective view of a first preferred embodiment of the present invention.
Figure 3:
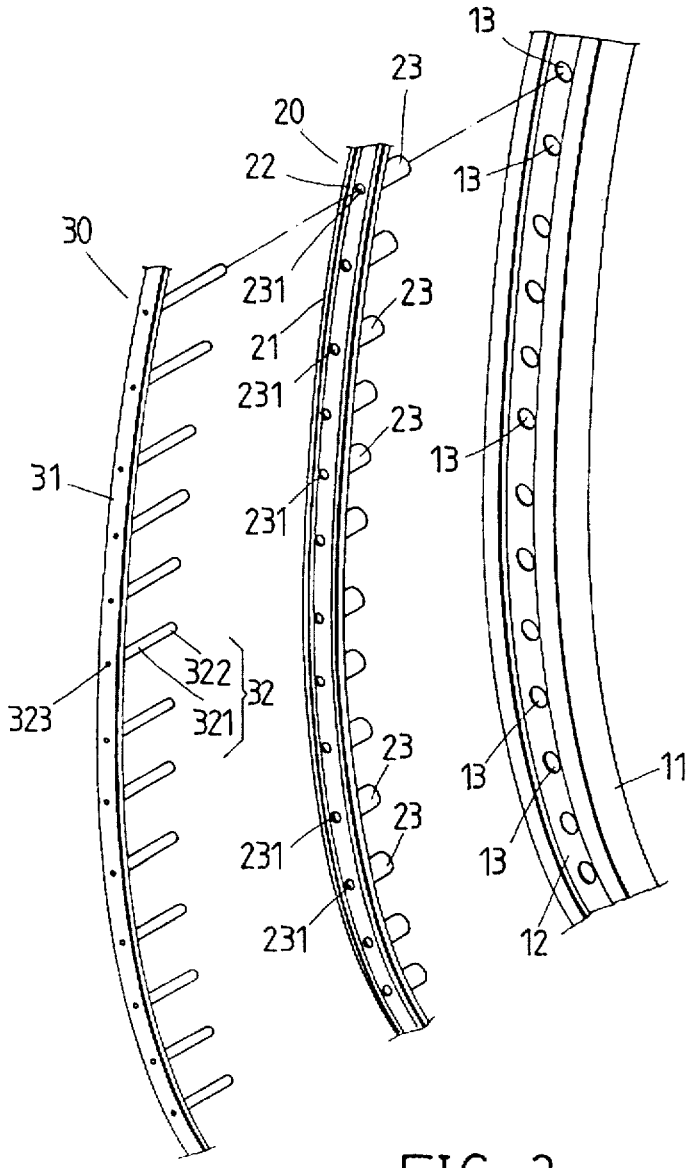
FIG. 3 shows an exploded view of the first preferred embodiment of the present invention.
Figure 4:
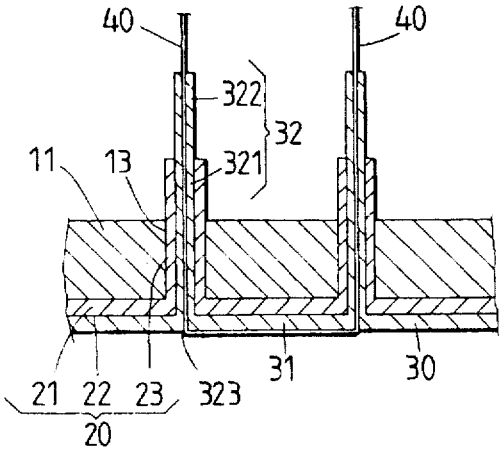
FIG. 4 shows a partial sectional view of the first preferred embodiment of the present invention.

As shown in FIGS. 2–4, a game racket 10 embodied in the present invention is composed of a head frame 11, a neck extending from one end of the head frame 11, and a handle extending from one end of the neck. The head frame 11 is provided in the outer wall thereof with a recessed portion 12 having a plurality of string holes 13 for accommodating the strings 40.

The string holes 13 of the head frame 11 are provided respectively with a string protective jacket 23 fastened securely thereinto for protecting the string 40 from the mechanical friction between the inner wall of the string hole 13 and the string 40.

As shown in FIG. 3, a string protective strip 20 of a rigid plastic body is composed of a strip body 21 having a U-shaped cross section. The strip body 21 is provided with a recess 22 and a plurality of string protective jackets 23 corresponding in location to the string holes 13 of the head frame 11. The string protective jackets 23 are tubular in shape and provided with an axial through hole 231. The strip body 21 is located in the recessed portion 12 of the head frame 11 such that the string protective jackets 23 are fitted securely into the string holes 13.

A shock-absorbing strip 30 of a rubber material has a strip body 31 which is provided with a plurality of shock-absorbing bodies 32 corresponding in location to the axial through holes 231 of the string protective jackets 23. The shock-absorbing bodies 32 are provided with a fitting portion 321, a shock-absorbing portion 322, and a through hole 323 extending in the longitudinal direction of the shock-absorbing body 32. The shock-absorbing strip 30 is located in the recess 22 of the strip 20 such that the fitting portions 321 of the shock-absorbing bodies 32 are fitted into the axial through holes 231 of the string protective jackets 23, and that the shock-absorbing portions 322 are exposed from the free ends of the string protective jackets 23.

The shock-absorbing effect of the present invention is brought about by the shock-absorbing strip 30, which prevents the strings 40 from making a direct contact with the head frame 11. In other words, when the strings 40 are impacted on by a ball, the shock wave so generated is prevented from being transmitted from the strings 40 to the head frame 11 and then on to the neck and the handle of the game racket, 10, thanks to the shock-absorbing strip 30 which serves to isolate the strings 40 from the head frame 11. In addition, the strings 40 are received in the through holes 323 of the shock-absorbing bodies 32 such that the shock waves of the strings 40 are mitigated by the vibration frequency of the shock-absorbing portions 322 of the shock-absorbing bodies 32, which are held securely in the string protective jackets 23.

Figure 5:
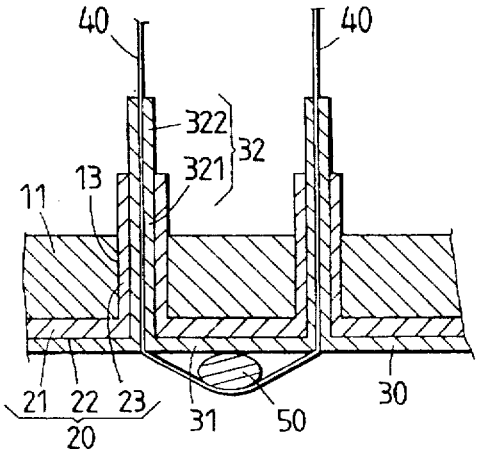
FIG. 5 shows a partial sectional view of a second preferred embodiment of the present invention.

As shown in FIG. 5, the present invention is modified such that a shock-absorbing block 50 of a rubber material is located on the outer surface of the shock-absorbing strip 30 such that the shock-absorbing block 50 is located between two shock-absorbing bodies 32, and that the string 40 is supported on the shock-absorbing block 50.

Figure 6:
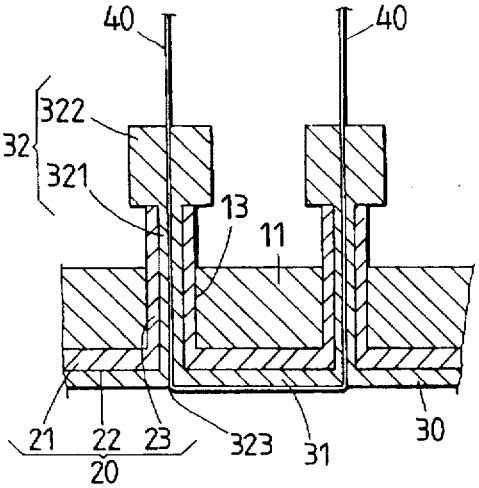
FIG. 6 shows a partial sectional view of a third preferred embodiment of the present invention.

A further modification of the present invention is shown in FIG. 6.

The shock-absorbing portion 322 of the shock-absorbing body 32 is substantially enlarged such that the shock-absorbing portion 322 has a cross section which is greater than the cross section of the fitting portion 321. The enlarged shock-absorbing portion 322 is capable of enhancing the shock-absorbing effect of the present invention.

Figure 7:
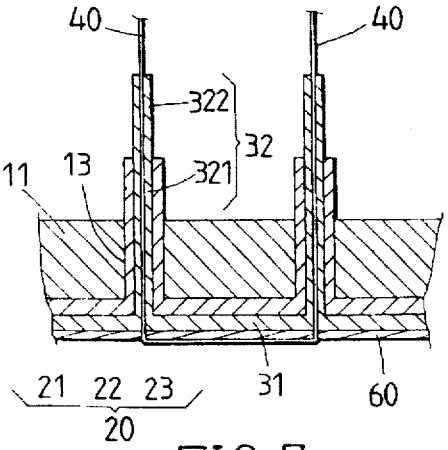
FIG. 7 shows a partial sectional view of a fourth preferred embodiment of the present invention.

As shown in FIG. 7, the shock-absorbing strip 30 of the present invention is protected by a protective layer 60 of a wear-resistant material so as to prolong the service life span of the shock-absorbing strip 30.

What is claimed is:

1. A game racket comprising a head frame, a neck extending from the head frame, and a handle fastened with one end of the neck, said head frame provided in an outer wall thereof with a recessed portion extending throughout the outer wall of said head frame, said recessed portion having a plurality of string holes separated from one another by a predetermined distance for accommodating a plurality of strings forming a ball-striking surface of said head frame;

wherein said head frame comprises:

a string protective strip provided in one side thereof with a recess and in another side thereof with a plurality of string protective jackets tubular in shape and having an axial through hole, said string protective strip secured to the recessed portion of said head frame such that said string protective jackets are received in the string holes of the head frame;

a shock-absorbing strip provided in one side thereof with a plurality of shock-absorbing bodies corresponding in location to said string protective jackets and having a fitting portion, a shock-absorbing portion and a through hole extending in a longitudinal direction of said shock-absorbing bodies, said shock-absorbing strip secured to said recess of said string protective strip such that said shock-absorbing bodies are fitted into said axial through holes of said string protective jackets, and that the strings are put through said through holes of said shock-absorbing bodies, and further that said shock-absorbing portions of said shock-absorbing bodied are exposed from free ends of said string protective jackets.

2. The game racket as defined in claim 1, wherein said shock-absorbing strip is provided on another side thereof with a plurality of shock-absorbing blocks attached thereto such that each of said shock-absorbing blocks is located between two of said shock-absorbing bodies of said shock-absorbing strip, and that the strings are supported on said shock-absorbing blocks.

3. The game racket as defined in claim 1, wherein said string protective strip is made of a rigid plastic material; and wherein said shock-absorbing strip is made of a rubber material.

4. The game racket as defined in claim 2, wherein said shock-absorbing blocks are made of a rubber material.

5. The game racket as defined in claim 1, wherein said shock-absorbing portion of said shock-absorbing bodies is greater in cross section than said fitting portion of said shock-absorbing bodies.

6. The game racket as defined in claim 1, wherein said shock-absorbing strip is provided with a wear-resistant protective layer attached thereto.

* * * * *